US010648202B2

(12) United States Patent
Scholz et al.

(10) Patent No.: US 10,648,202 B2
(45) **Date of Patent: *May 12, 2020**

(54) LOCKING DEVICE FOR A MOTOR VEHICLE HOOD, AND METHOD

(71) Applicant: Kiekert AG, Heiligenhaus (DE)

(72) Inventors: Michael Scholz, Essen (DE); Holger Schiffer, Meerbusch (DE)

(73) Assignee: Kiekert AG, Heiligenhaus (DE)

( * ) Notice: Subject to any disclaimer, the term of this patent is extended or adjusted under 35 U.S.C. 154(b) by 878 days.

This patent is subject to a terminal disclaimer.

(21) Appl. No.: 15/107,304

(22) PCT Filed: Dec. 9, 2014

(86) PCT No.: PCT/DE2014/100434

§ 371 (c)(1),
(2) Date: Jul. 25, 2016

(87) PCT Pub. No.: WO2015/096830

PCT Pub. Date: Jul. 2, 2015

(65) Prior Publication Data

US 2016/0340939 A1 Nov. 24, 2016

(30) Foreign Application Priority Data

Dec. 23, 2013 (DE) ..... 10 2013 022 059

(51) Int. Cl.
*E05B 81/20* (2014.01)
*E05B 81/16* (2014.01)
(Continued)

(52) U.S. Cl.
CPC ..... *E05B 81/20* (2013.01); *E05B 79/08* (2013.01); *E05B 81/06* (2013.01); *E05B 81/16* (2013.01);
(Continued)

(58) Field of Classification Search
CPC ..... Y10T 292/696; Y10T 292/699; Y10T 292/702; Y10S 292/60; E05B 79/04; E05B 81/20
(Continued)

(56) References Cited

U.S. PATENT DOCUMENTS 4,982,984 A * 1/1991 Yokota ..... E05B 81/22 292/201
5,273,325 A * 12/1993 Zimmermann ..... E05B 81/22 292/216
(Continued)

FOREIGN PATENT DOCUMENTS

CN 102762807 A 10/2012
CN 203247947 U 10/2013
(Continued)

OTHER PUBLICATIONS

International Search Report and Written Opinion for corresponding patent application No. PCT/DE2014/100434 dated Jun. 1, 2015.

*Primary Examiner* — Carlos Lugo
(74) *Attorney, Agent, or Firm* — Renner, Otto, Boisselle & Sklar, LLP

(57) ABSTRACT

A locking device and method for locking the locking device includes a lock for a door or a hatch for a hood of a motor vehicle. The lock having includes a locking mechanism that has a rotary latch and at least one pawl for blocking the rotary latch. The locking device includes a drive which allows the locking mechanism to be moved in such a way that a door gap or hatch gap can be narrowed in the closed state of the door or hatch. The lock is an electric lock that includes an electric drive which allows the locking mechanism to be brought into the main blocking position of the locking mechanism and/or allows the lock to be opened.

7 Claims, 13 Drawing Sheets

Figure 1:
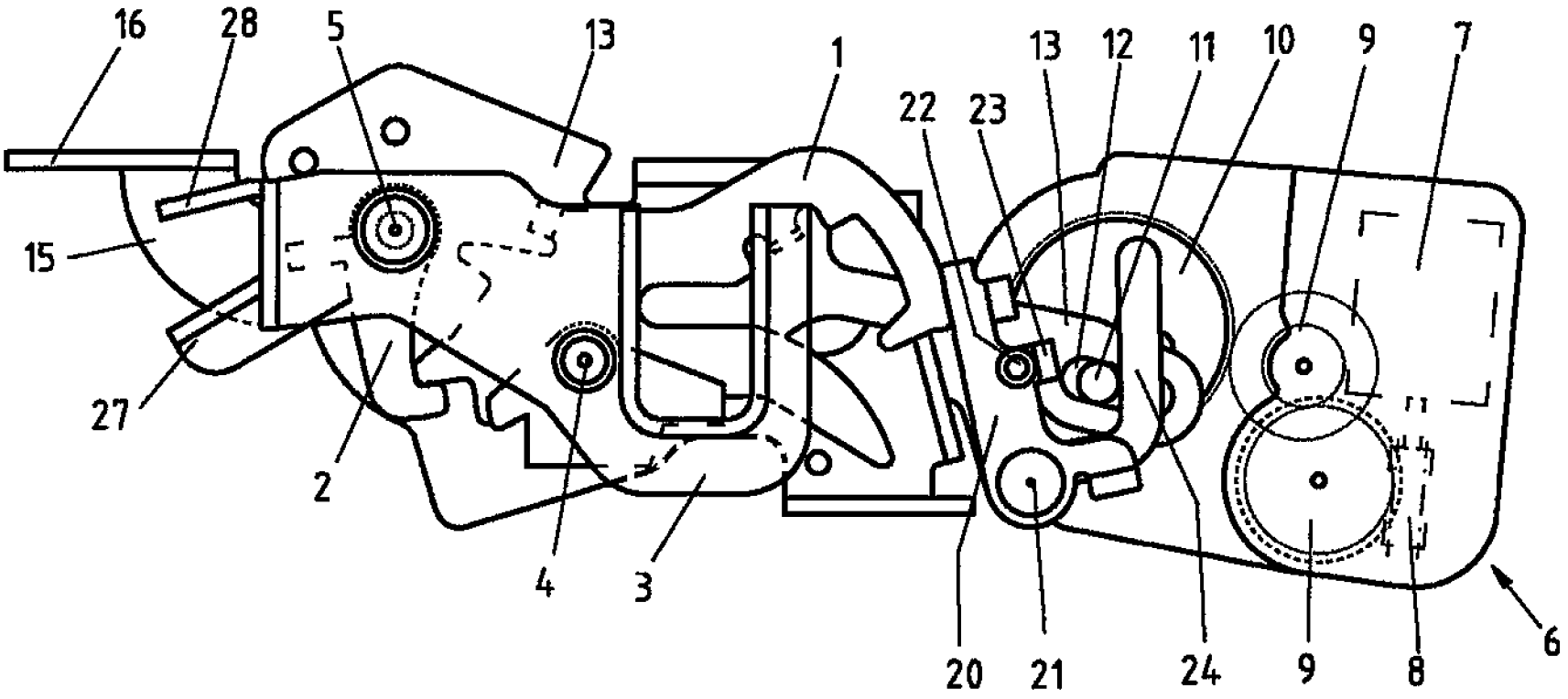

(51) Int. Cl.

| | |
|---|---|
| ***E05B 81/06*** | (2014.01) |
| ***E05B 83/24*** | (2014.01) |
| ***E05B 81/64*** | (2014.01) |
| ***E05B 79/08*** | (2014.01) |
| ***E05B 81/66*** | (2014.01) |
| ***E05B 81/68*** | (2014.01) |
| *E05B 79/04* | (2014.01) |

(52) U.S. Cl.
CPC ..... *E05B 81/64* (2013.01); *E05B 81/66* (2013.01); *E05B 81/68* (2013.01); *E05B 83/24* (2013.01); *E05B 79/04* (2013.01); *Y10S 292/60* (2013.01); *Y10T 292/696* (2015.04); *Y10T 292/699* (2015.04)

(58) Field of Classification Search
USPC ..... 292/201
See application file for complete search history.

(56) References Cited

U.S. PATENT DOCUMENTS

| | | | | | |
|---|---|---|---|---|---|
| 5,443,292 | A * | 8/1995 | Shimada | E05B 81/20 | 292/201 |
| 5,938,252 | A * | 8/1999 | Uemura | E05B 81/14 | 292/201 |
| 5,938,254 | A * | 8/1999 | Weyerstall | E05B 81/22 | 292/144 |
| 6,805,386 | B2 * | 10/2004 | Ehret | E05B 81/20 | 292/141 |
| 7,000,956 | B2 * | 2/2006 | Fisher | E05B 81/14 | 292/198 |
| 7,367,598 | B2 * | 5/2008 | Arabia, Jr. | E05B 81/22 | 292/201 |
| 7,938,458 | B1 * | 5/2011 | Zweibohmer | E05B 15/0006 | 292/197 |
| 7,954,898 | B2 * | 6/2011 | Van De Geer | B60N 2/01583 | 292/200 |
| 10,309,130 | B2 * | 6/2019 | Schiffer | E05B 79/04 | |
| 2003/0094820 | A1 * | 5/2003 | Erices | E05B 81/22 | 292/341.16 |
| 2007/0029814 | A1 * | 2/2007 | Coleman | E05B 81/14 | 292/201 |
| 2011/0260475 | A1 * | 10/2011 | Spurr | E05B 81/14 | 292/195 |

FOREIGN PATENT DOCUMENTS

| | | | | | |
|---|---|---|---|---|---|
| DE | 37 21 962 | A1 | | 1/1989 | |
| DE | 19520359 | A1 | * | 12/1996 | E05B 1/20 |
| DE | 299 15 905 | U1 | | 9/1999 | |
| DE | 19835994 | A1 | * | 2/2000 | E05B 1/20 |
| DE | 100 33 092 | A1 | | 1/2002 | |
| DE | 10 2004 011 798 | B3 | | 10/2005 | |
| DE | 10 2004 013 671 | A1 | | 10/2005 | |
| DE | 10 2004 043 661 | A1 | | 3/2006 | |
| DE | 10 2004 040 157 | B3 | | 7/2006 | |
| DE | 102005048564 | | * | 4/2007 | |
| DE | 102005060750 | A1 | * | 6/2007 | B60R 21/38 |
| DE | 102006002338 | A1 | * | 7/2007 | B60R 21/34 |
| DE | 102006012090 | B3 | * | 10/2007 | B60R 21/34 |
| DE | 10 2007 056 691 | A1 | | 6/2009 | |
| DE | 10 2008 005 181 | A1 | | 7/2009 | |
| DE | 10 2009 01818 | A1 | | 11/2010 | |
| DE | 10 2009 026 921 | A1 | | 12/2010 | |
| DE | 10 2013 109 051 | | | 2/2015 | |
| EP | 1 489 252 | A2 | | 12/2004 | |
| EP | 2096007 | A1 | * | 9/2009 | B60R 21/38 |
| FR | 2 889 554 | A1 | | 2/2007 | |
| WO | WO 2005/093195 | A2 | | 10/2005 | |
| WO | WO 2010/142280 | A1 | | 12/2010 | |
| WO | WO 2015/024555 | A1 | | 2/2015 | |

* cited by examiner

LOCKING DEVICE FOR A MOTOR VEHICLE HOOD, AND METHOD

The invention relates to a locking device comprising a latch for a door or a hatch and in particular for a hood of a motor vehicle, said latch having a locking mechanism that comprises a catch and at least one pawl for blocking the catch. The locking device comprises a drive which allows the locking mechanism to be moved in such a way that a door gap or hood gap can be reduced in the closed state of the door or hatch. The invention further relates to a method for locking the locking device.

A latch of a locking device of the type described above is used for intermittent closing of openings in motor vehicles or buildings with the aid of doors or hatches. In the closed state of such a latch, two arms of the catch (referred to as load arm and collecting arm) grip around an, in particular, bow-shaped locking bolt. In a motor vehicle, the locking bolt can be fixed to a door or hatch of the motor vehicle and the latch to the motor vehicle body or vice versa. Motor vehicles contain, in particular, side door latches, hatchback latches, hood latches and bonnet latches. The present invention is particularly advantageous for front hoods and front hatches located at the front of a vehicle when looking in the usual driving direction.

The latch generally contains a frame box or a latch plate as well as a latch cover for locking the frame box. The frame box and latch cover are also referred to as latch housing. The locking mechanism, i.e. the catch and pawl are generally pivotally mounted on the frame box. For reasons of stability, the frame box, catch and/or pawl are advantageously made of metal. For weight reasons, the latch cover is, amongst other things, made of plastic. A latch plate or frame box generally contains an intake area for the locking bolt. Said intake area can, for instance, consist of a U-shaped indentation, allowing the locking bolt to engage in the catch.

As usual, the latch housing can be arranged on the motor vehicle body or hood and door side. In the first embodiment, the latch housing is attached to the motor vehicle body by, for instance, bolts. In the second embodiment, the latch housing and thus the door latch is attached inside or on a door, hood, hatch or similar.

Consequently, a distinction is actually being made between side door latches, hatchback latches and hood latches or bonnet latches. All of these are referred to as motor vehicle latches. It is particularly preferred for a locking device to contain such a motor vehicle door latch.

As part of the invention, the latch housing is regularly arranged on the motor vehicle body side, i.e. is located on an associated motor vehicle body. In contrast, the locking bolt is connected to a hood so that in most cases a hood latch or bonnet latch is provided. Generally, the arrangement can, however, also be reversed. In this case, the locking bolt is attached to the body or motor vehicle body, whilst the latch housing and the motor vehicle door latch is attached to the hood or generally on the door side.

When, starting from an open position, the catch of such a latch reaches a closed position by pivoting, the catch is eventually locked by the pawl. Such pivoting is achieved by the locking bolt (also referred to as "latch holder") when it engages in the catch as a result of locking an associated door or hatch. In the locked state, a blocking surface of the pawl rests against a blocking surface of the catch, preventing the catch from being pivoted back in the direction of the open position. Once in the closed position, the locking bolt can no longer leave the locking mechanism.

In order to open the locking mechanism, the pawl must be moved out of its ratchet position. Once the pawl has been moved out of its ratchet position, the catch turns in the direction of the open position. In the open position of the catch and thus in the open position of the locking mechanism, the locking bolt can leave the latch. The door or hatch can thus be opened again.

Some latches provide two different ratchet positions for the catch. In this arrangement, the catch can first be latched in the so-called pre-ratchet position and finally in the so-called main ratchet position after continued pivoting in the locking direction. In the pre-ratchet position, a locking bolt can no longer leave the locking mechanism. A respective door or hatch is, however, not fully closed. Such a door or hatch is only fully closed once the catch has been pivoted up to the main ratchet position and is locked in this position. A second pawl can be provided for locking in the pre-ratchet position. It is, however, also possible to lock the catch in the pre-ratchet and in the main ratchet position, using only one pawl. Such a latch can contain an electric drive to move a locking mechanism locked in the pre-ratchet position into the main ratchet position in order to eventually latch the locking mechanism in the main ratchet position. Such a latch is also referred to as a latch with a closing aid. A latch with a closing aid is disclosed in DE 10 2009 026 921 A1.

DE 10 2008 005 181 A1 discloses a closing aid pulling a hatch or a door of a motor vehicle towards the motor vehicle body. The disclosed drive also serves to open the door or hatch. A combined closing and electric opening of a tailgate latch is disclosed in patents DE 100 33 092 A1, DE 10 2004 011 798 B3 and DE 10 2004 013 671 A1.

An actuating device is provided for opening a latch. Once the actuating device is operated, the locking mechanism opens. A handle of a door or of a hatch can be part of the actuating device. The handle is generally connected to the actuating lever of the latch by means of rods or a Bowden cable. Upon actuation of the handle, the rods or Bowden cable pivot the actuating lever of the latch in such a way that the latch opens. A motor vehicle can contain a generally pivotable outer handle reachable from the outside and a generally pivotable inner handle, reachable from the inside.

Where a locking mechanism of a motor vehicle is locked by closing a door or hatch, generally a gap remains between the door or hatch and the adjoining motor vehicle body. In particular in case of hoods, located at the front of motor vehicles when viewed in the driving direction, this gap should be as small as possible in order to prevent disadvantageous air turbulences at the front and thus any resulting air resistance during driving. A continuous closed surface with preferably no gap is, however, also desirable for optical reasons.

Practical applications and prior art as disclosed in EP 1 489 252 B1 preferably use closing and opening aids, generally ensuring that once a certain preliminary closing position has been reached, the gap between the motor vehicle body and the hood or door to be closed is reduced (closed position). This is generally achieved with the aid of a motor or a motorized drive, although in principle, mechanical closing or locking is also possible and included. In addition, also opening devices are known with the aid of which the respective hood or motor vehicle hood or door or motor vehicle door can be opened or moved away from the motor vehicle body. Such closing/opening devices can generally also be combined.

In most cases, embodiments generally only contain one closing aid or closing means pulling a motor vehicle door located, for instance, in the pre-ratchet position of the locking mechanism into the main ratchet position with the aid of a motor. In the generic state of the art disclosed in EP 1 489 252 B1, this is achieved by a rocker arm being acted upon. The motorized drive acts on a toggle lever element containing two toggle levers. In this way a correct mechanical activation of the locking mechanism can be ensured during a mechanical closing operation even if the motorized drive fails. This arrangement has proven to be successful.

In recent times and, in particular, in so-called hood latches, i.e. motor vehicle door latches on a motor vehicle hood or in the area of the motor vehicle hood, the requirement is for the gap between the motor vehicle door or the motor vehicle hood and the motor vehicle body to be as small as possible and, where possible, to be reduced to 0 mm or nearly 0 mm. This is not only a requirement solely for aesthetic reasons, providing the smoothest possible and continuous closed surface for a modern vehicle. In fact, the size of the gap in this area has a direct effect on air circulation in the front section, which depending on its generation and manifestation can adversely affect air resistance. At this point no convincing solutions have been provided until now. The invention aims to remedy this by providing an advantageous embodiment.

The initial German patent application DE 10 2013 109 051 discloses the reduction of such gaps in doors or hatches to a minimum. The disclosed latch is moveably and, in particular, pivotally mounted. After blocking of the locking mechanism, the latch is moved or pivoted in its entirety by the drive in such a manner that a gap between the door or hatch and car body is reduced to a minimum. The drive provided for this purpose contains an electric motor and a pivotable lever, referred to as a rocker arm. By pivoting the lever or the rocker arm (hereinafter also referred to as "rocking lever") by means of an electric motor, the entire latch is pivoted in such a way that the gap is minimized. At the same time, the latch housing is retained by a pawl pivotally mounted on the rocker arm. The locking device disclosed in printed matter DE 10 2013 109 051 thus contains a drive of the aforementioned type, for moving the entire latch and thus also the locking mechanism in such a way that a door gap or hatch gap, remaining after closing of the door or hatch, can be reduced.

When closing a door or hatch, a load (impact) is exerted on the latch. Such an impact can damage the drive disclosed in DE 10 2013 109 051.

Unless specified differently below, the object of the invention can contain some or any combination of the above characteristics.

The aim of the development is, in particular, to position moveable motor vehicle components and, in particular the motor vehicle hood, directly over attached parts, such as headlights, a radiator grill or the motor vehicle body. The motor vehicle hood should be positioned on or directly over the other attached parts in order to achieve a 0-joint. Such joints between attached parts and/or the motor vehicle body and the hood can, as described, on one hand influence the aerodynamics of the motor vehicle and can have, on the other hand, a considerable effect on the visual and thus overall quality impression of the vehicle.

One of the tasks to solve is the fact that during closing of the motor vehicle hood, the hood normally carries out an overtravel movement, predominantly due to the weight. Overtravel refers in this case to the desired position of the closed hood being exceeded with the hood moving beyond the desired position so that a 0-joint cannot be achieved using conventional latches.

The invention has the task of providing a locking device and a method for minimizing a gap of a door or hatch.

In order to solve this task, a locking device contains the characteristics of claim 1. Advantageous embodiments are disclosed in the dependent claims.

A locking device for a door or hatch contains a latch having a locking mechanism that comprises a catch and pawl for blocking the catch. A drive is provided with the aid of which the locking mechanism can be fully or partly moved in such a way that a door gap or hatch gap can be reduced. Where thus a door or hatch is closed, a gap first of all remains between the door and door frame or between a frame and the associated hatch. With the aid of the drive, the locking mechanism or parts of the locking mechanism can be moved in such a way that the gap is reduced.

In one embodiment, the latch contains a closing aid in order to reduce said gap by partial movement of the locking mechanism. Such a latch with a closing aid contains a catch that can be locked in a pre-ratchet position and in a main ratchet position by at least one pawl. Where the catch is locked by a pawl, a blocking surface of the pawl directly rests against a blocking surface of the catch. As a result, the catch is reliably locked so that this locking mechanism can also not open when exposed to a greater external load.

In a particularly preferred embodiment, the latch and closing aid contains a securing mechanism, preventing manual movement of the locking mechanism from the pre-ratchet to the main ratchet position. A stop for a closing shackle may be provided, preventing the closing shackle from being moved that deep into the infeed section of a catch when locking a door or a hatch that the catch can be locked in the main ratchet position. Where the locking mechanism is locked in the pre-ratchet position by the pawl, this position is, for instance registered by a micro switch by actuation. When the micro switch registers the pre-ratchet position, the micro switch is thus activated. The activation of the micro switch then initiates an electric drive. The drive moves the stop out of its stop position. The catch is then turned in the direction of the main ratchet position by means of an electric drive until the catch is locked in the main ratchet position.

In order to minimize the gap, this design is thus predominantly based on the concept of providing a latch which can be locked in a pre-ratchet and main ratchet position by at least one pawl. The embodiment contains a closing aid in order to lock the locking mechanism in its main ratchet position, starting from its pre-ratchet position. Furthermore, a closing aid is provided, ensuring that the latch can be locked in the main ratchet position with the aid of an electric drive.

This embodiment ensures that the catch cannot be pivoted to the main ratchet position too fast. This ensures that no excessive overtravel occurs. In contrast to conventional latches with pre-ratchet position and main ratchet position, a gap between a hatch or a door and a motor vehicle body can thus be minimized, as it can be designed in such a way that that only a very small overtravel is possible. It is, thus in particular, possible to reduce the gap to 4 mm or less. It is even possible to achieve a gap of 3 mm and less.

The engagement of a locking bolt that can be attached to a frame or a door, hatch or hood in a catch causes an impact. In order to prevent any damage resulting from such an engagement, a stop for the catch is mounted on a plate in one embodiment. For reasons of stability, this plate is preferably made of metal and is, in particular, attached to the motor vehicle body or a door or hatch of a motor vehicle. The plate can also be part of a motor vehicle body.

The load produced by said impact is transferred from the catch to the plate by means of the stop. In other words: if a locking bolt engages in the catch, the locking bolt turns the catch in the direction of the closing position. As a result of its rotation, the catch finally makes contact with the stop and transfers the load associated with the impact onto the stop. The load transferred onto the stop is then transferred onto the plate via the fixing of the stop on the plate. Any damage to the drive as a result of the impact and any thus associated mechanical loading is avoided. The load does not have to be directly transferred by the catch onto the stop. Indirect transfer of the load onto the stop suffices.

Advantageously, the locking device is designed in such a way that the catch is locked by the pawl before the load is applied onto the stop. This ensures particularly reliably that the locking mechanism can be locked as planned. Because of the aforementioned reasons, the catch is advantageously locked in the pre-ratchet position. The stop then prevents the catch from being locked in the main ratchet position.

In one embodiment, the latch housing and thus a locking mechanism arranged in the housing are mounted on a base element allowing pivoting around an axis. The movement of the latch housing as part of the closing or opening process is caused by a pivoting movement of the latch housing around said axis. Alternatively or in addition, the catch is, after reaching the pre-ratchet position, pivoted by a drive, i.e. not manually, into the main ratchet position, where it is locked.

For reasons of stability, the frame box or the latch plate of the latch housing is preferably pivotally mounted. The catch and pawl are pivotally connected to the frame box or latch plate by means of axes. With the aid of the drive the frame box or the latch plate are pivoted in such a way that a gap of a door or hatch can ultimately be reduced. Although the existence of a latch cover is advantageous, it is not mandatory for this embodiment.

Preferably, the frame box or the latch plate is pivotally mounted on the plate on which the stop is fixed. This keeps the number of components and the required installation space to a minimum.

In one embodiment of the invention, a rocking lever (rocker arm), i.e. a pivotable lever is connected to the pivotally mounted frame box by means of a common axis. The term axis also refers to a shaft. The drive can move the free end of the rocking lever and thus also the pivotally mounted frame box in order to reduce a gap of the door or hatch. As a result of this design, lever forces can be suitably used to move the locking mechanism with a suitable force in order to reduce a gap of a door or hatch. Such an embodiment represents an independent invention irrespective of the stop, solving the technical problem of being able to minimize a door gap or hatch gap by means of a locking device with a simple design.

In one embodiment of the invention, the frame box extends, when viewed from the common axis, in the same direction as the rocking lever. This advantageously reduces the required installation space.

In one embodiment of the invention, the rocking lever extends, when viewed from the common axis, past the inlet section of the frame box or of the latch box. In this way, favorable lever conditions are provided in order to be able to use a low-power electric motor which advantageously can have a particularly small design.

In one embodiment, the described closing/opening process can also be manually operated. A manually activatable Bowden cable can suitably act on the locking device. Generally, a motorized drive is, however, provided for the closing and/or opening device.

Advantageously, the drive only moves the entire locking mechanism in order to minimize a door gap or hatch gap when the latch is in its main ratchet position. Consequently this embodiment contains, in particular, a sensor or a micro switch in order to determine when the locking mechanism is in the main ratchet position. Once the sensor or micro switch has registered that the locking mechanism is in the main ratchet position, the sensor or micro switch actuates the drive in order to reduce the still existing gap of a door or hatch and to minimize it as far as possible. In this embodiment, too, the catch has first of all been advantageously moved from the pre-ratchet to the main ratchet position by means of a closing aid in order to minimize the gap by this movement alone. The locking mechanism as a whole then only needs to be moved on slightly to avoid practically any gap (zero gap). As a result, the required installation space can be reduced to a minimum.

Preferably, the rocking lever is pivotally mounted on one or several plates. The one or several plates are preferably made of metal for reasons of stability. The one or several plates preferably contain tabs with which the plates can be attached to the plates on the motor vehicle body or on a door or hood of a motor vehicle. The one or several plates then serve, on one hand, for pivotable mounting of the rocking lever and, on the other hand, for fixing to the motor vehicle.

The stop is preferably pivotally mounted on the plate. This embodiment allows moving the stop from its stop position, when required and, in particular, by means of an electric drive.

Preferably, the drive that can move the locking mechanism can also move the stop in order to reduce the number of required drives. Preferably, the drive is also a part of the closing aid.

In one embodiment, the drive can rotate a disk from which an eccentrically arranged bolt protrudes. The bolt is thus remotely arranged from the centre of rotation or rotation axis of the disk. The bolt extends into a slot of the rocking lever in order to move the locking mechanism. This means that a rotation of the disk causes the rocking lever to pivot and thus movement of the locking mechanism.

Alternatively or in addition, the pin is used in order to suitably move the stop. In particular, it is thus advantageously possible to move the stop out of its stop position after the entire load has been transferred onto the stop. After having moved the stop out of its stop position, the locking mechanism can then be moved to reduce the gap.

The pivotable components of the locking device can be pretensioned by springs in order to move components in the desired position by the force of the springs.

In an alternative embodiment—not shown—closing of the hood down to a zero joint or a zero gap dimension is achieved by means of the pawl. In this case, the catch preferably forms the axis of rotation for the latch. In this arrangement, the drive acts on the pawl, thus allowing the hood to achieve a zero gap dimension after locking the locking mechanism. This embodiment is an independent invention irrespective of the stop but can be combined with the aforementioned characteristics. In this case the pawl forms a rocking lever that can be moved by the drive in order to minimize a gap.

Preferably, the invention relates to a latch for a hood of a motor vehicle and, in particular, for an engine bonnet. Current motor vehicles have a gap dimension or joint of approximately five millimeters. This gap dimension is necessary as during locking, the hood carries out an overtravel of around 5 mm. Because of this overtravel, a gap dimension of at least 5 mm must exist between the hood and attached parts such as, for instance, a radiator grill or headlights.

In order to be able to reduce this gap dimension to zero, where possible, one embodiment that represents an independent invention, contains a door or hatch, such as a hood which is engaged in a pre-ratchet position and is then, preferably by means of an electric motor drive, moved on from the pre-ratchet to the main ratchet position. For this purpose, closing elements known from power latches can, for instance, be used. Closing is, in particular, achieved by means of the catch.

In a further embodiment, the catch contains a pre-ratchet and a main ratchet position which is entered into by the bonnet latch during locking of the front hatch. Upon reaching the main ratchet position, the catch would then be pulled into an overtravel position of, for instance, six millimeters by means of a drive. For this purpose, a third ratchet position is provided, for instance, on the catch.

In a further embodiment, the entire latch unit is moved into a zero gap position. In this arrangement the latch is mounted in an eccentric drive so that the latch would close in an elevated position. After closing of the latch, the entire latch is then pivoted by means of the drive and preferably by means of a electric motor drive, so that the door or hatch can be moved into a zero joint position again.

The examples show that there are various ways in which the gap dimension can be reduced. It is not necessary to move the entire latch. It can suffice to move the catch by means of a drive.

In one arrangement, the invention is based on the technical problem of further developing such a locking device so that by using simple means, a very small gap dimension can be provided between motor vehicle body and door or hood.

In order to solve this technical problem, a generic locking device of the invention is characterized by the closing and/or opening means engaging with the outside of the latch housing to allow its adjustment in relation to a fixed base element as part of the closing/opening operation.

As the latch housing is typically arranged on the motor vehicle body side, i.e. on a motor vehicle body or is connected to a motor vehicle body, the fixed base element is part of this motor vehicle body. Generally, the motor vehicle body of the invention or hood latch is located in the area of a top beam on the front of the motor vehicle body, typically arranged or extending in a horizontal manner.

Advantageously, the design is such that the latch housing is connected to the respective base element is such a manner that it can pivot around an axis or rotary axis. This means that the displacement of the latch housing as part of the closing/opening process corresponds to a pivoting movement of the latch housing around the respective axis or axis of rotation. For this purpose, the axis or axis of rotation is generally defined in such a way that, in the example, the top front beam of the motor vehicle body contains a respective bolt or pin on which the latch housing is pivotally mounted.

In order to achieve a particularly stable design at this point, the latch box is generally pivotally mounted on the respective bolt. In contrast, the latch cover is connected to the frame box and is being carried along in case of a pivoting movement of the frame box.

The described opening/closing process can generally be carried out by mechanical means. For this purpose, a Bowden cable can, for instance, act on a closing and/or opening device that can be manually actuated. Generally, a motorized drive is, however, provided for the closing and/or opening device. It has proven to be advantageous for the motorized drive to act eccentrically on the closing/opening device. It is also advantageous for the motorized drive to only act on the closing and/or opening device when the door lock is in its main ratchet position.

In general, the closing and/or opening device essentially comprises a rocker arm and a pawl, engaging with the latch housing. With the aid of the rocker arm a relative high torque can be exerted on the latch housing even if only a small motorized drive with somewhat limited power is used.

In most cases the rocker arm is pivotally connected to the base element. It has proven to be advantageous for the rocker arm and the latch housing to be connected to the base element in such a way that they are pivotable around a common axis. In this case, the bolt at the top front beam of the motor vehicle body advantageously functions as a common axis of rotation for the latch housing as well as for the rocker arm. This also allows a particularly compact and hardly protruding design.

The pawl, in turn, is generally pivotally mounted on the rocker arm. The pawl can be pretensioned with the aid of a spring. It is also proven to be advantageous for the pawl to engage with a projection on the latch housing. For reasons of stability, this projection on the latch housing can be advantageously formed on the frame box.

To activate the rocker arm and to move it around the common axis of rotation with the latch housing, the rocker arm mainly contains a slot allowing engagement by an actuating journal. The actuating journal is in turn advantageously acted upon by means of the motorized drive.

Generally, the design is such that the actuating journal is arranged on a drive wheel. The drive wheel can be rotated by means of the motor or electric motor. The electric motor contains a worm on its drive shaft engaging in gearing on the outside of the driving wheel in order to pivot said wheel in counterclockwise or clockwise direction around an associated axis. This results in movements of the actuating journal along a circular arc and within the slot of the rocker arm. The general design of such a motorized drive is disclosed in DE 299 15 905 U1.

This means that the actuating journal carries out a circular motion inside the slot of the rocker arm which is initiated by the motorized drive. In this way, the rocker arm and thus the latch housing can be pivoted around a common axis of rotation in relation to the base element. The pivoting movement of the rocker arm also causes the latch housing to be carried along by the pawl when the rocker arm rotates.

As a result, a locking device is provided that is particularly suitable for being able to provide narrow gap widths between associated door, hood and motor vehicle body that can be adjusted to 0 mm or nearly 0 mm. Essentially, the invention achieves this by the closing and/or opening device pivoting the entire latch housing in relation to a base element or a top and mostly horizontal front beam of the motor vehicle body. This means that in this embodiment, the closing and/or opening device expressly does not engage in a locking mechanism mounted on an associated frame box.

Instead, the locking mechanism is first moved into a main closing position or main ratchet position during locking of the door or hood. This position commences the closing process or locking process of the invention.

During this closing process or locking process, the entire latch housing together with the locking mechanism located in the main ratchet position and thus any retained locking bolts are pivoted around the axis of rotation in relation to the motor vehicle body. This can be carried out much more delicately and compared to, for instance, a closing movement on the catch, with much larger lever arms and thus greater torques. As a result, basically any gap width between the door or hood and the motor vehicle body can be achieved, down to 0 mm or close to 0 mm. This can all be achieved by means of a simple and functional design. These are the main advantages of the invention.

To minimize gap widths, also a combination of closing aid and a further drive for minimizing the gap can be provided.

According to the invention, an electrically activatable hood latch (electric latch) is used and alternatively combined with a closing aid.

At present, the hood latches are regularly opened by, in a first step, i.e. a first pulling of the hood opening lever, the latch or the catch hook of the locking mechanism entering a pre-ratchet position in which the hood is already opened by means of the force of a spring but in which the hood cannot be opened. Only after repeated pulling on the hood opening lever does the catch hook or the locking mechanism release the latch shackle of the hood, allowing the hood to be opened manually.

According to the present invention, an electrically activatable latch (with closing aid) is preferably combined with an electrically actuated adjusting device. In order to achieve a 0 joint, the hood latch is electrically moved as disclosed in the initial German patent applications 10 2013 109 051 and 10 2013 222 053 after which the locking mechanism is not manually but electrically released. An advantageous two-step opening process will thus be fulfilled. During closing, the hood closes or blocks the locking mechanism, in particular due to its inherent weight and the electric adjusting mechanism pulls the hood into the zero joints position.

An advantageous embodiment uses a two-stage locking mechanism and the locking mechanism is pulled closed into a main ratchet position by an electric motor after a pre-ratchet position is reached during closing of the hood.

The Figures show the following

Figure 2:
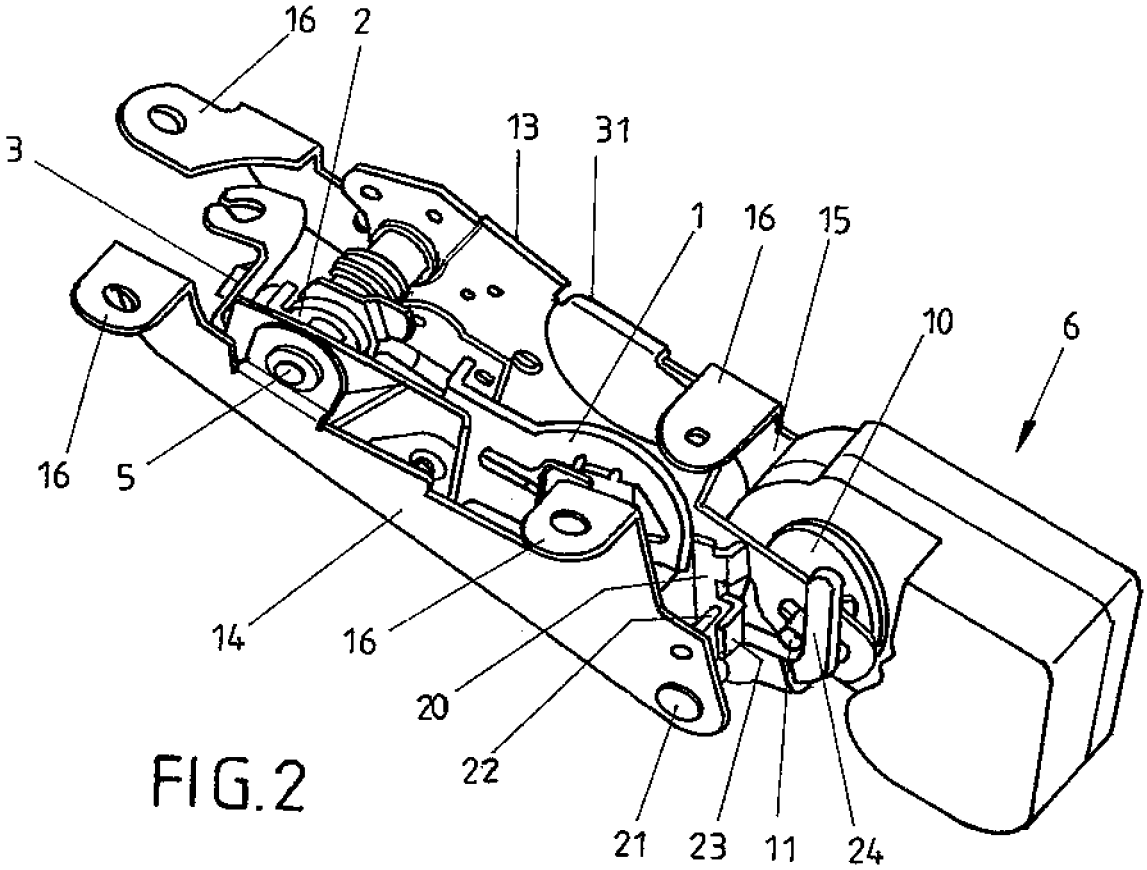
Figure 3:
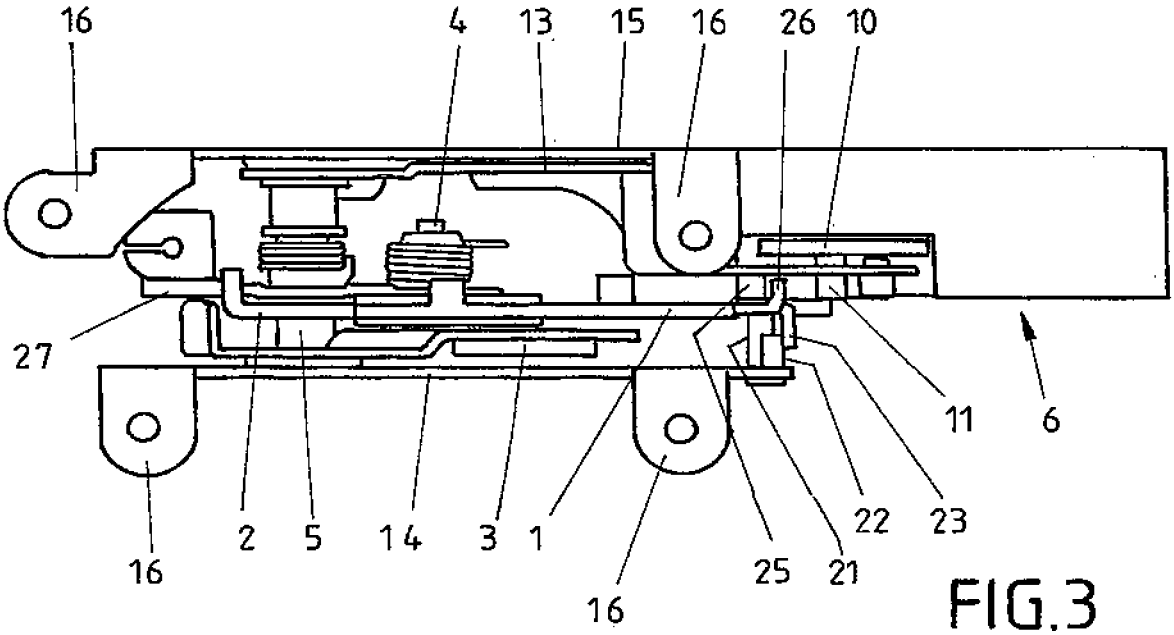
Figure 4:
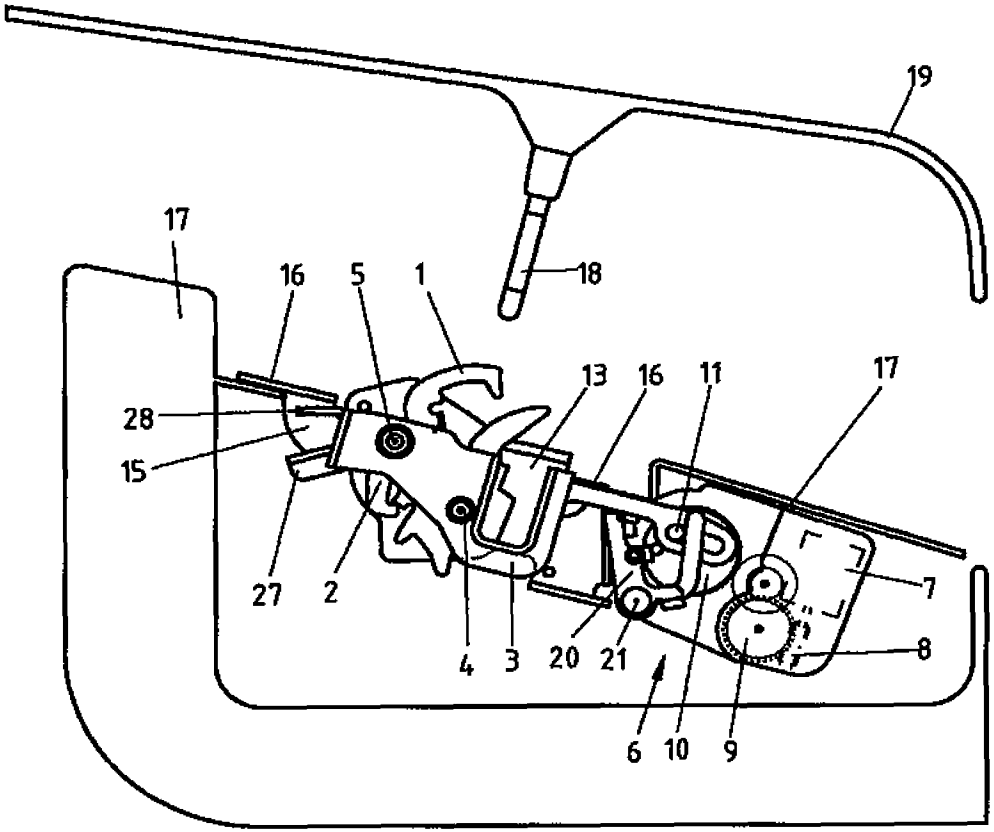
Figure 5:
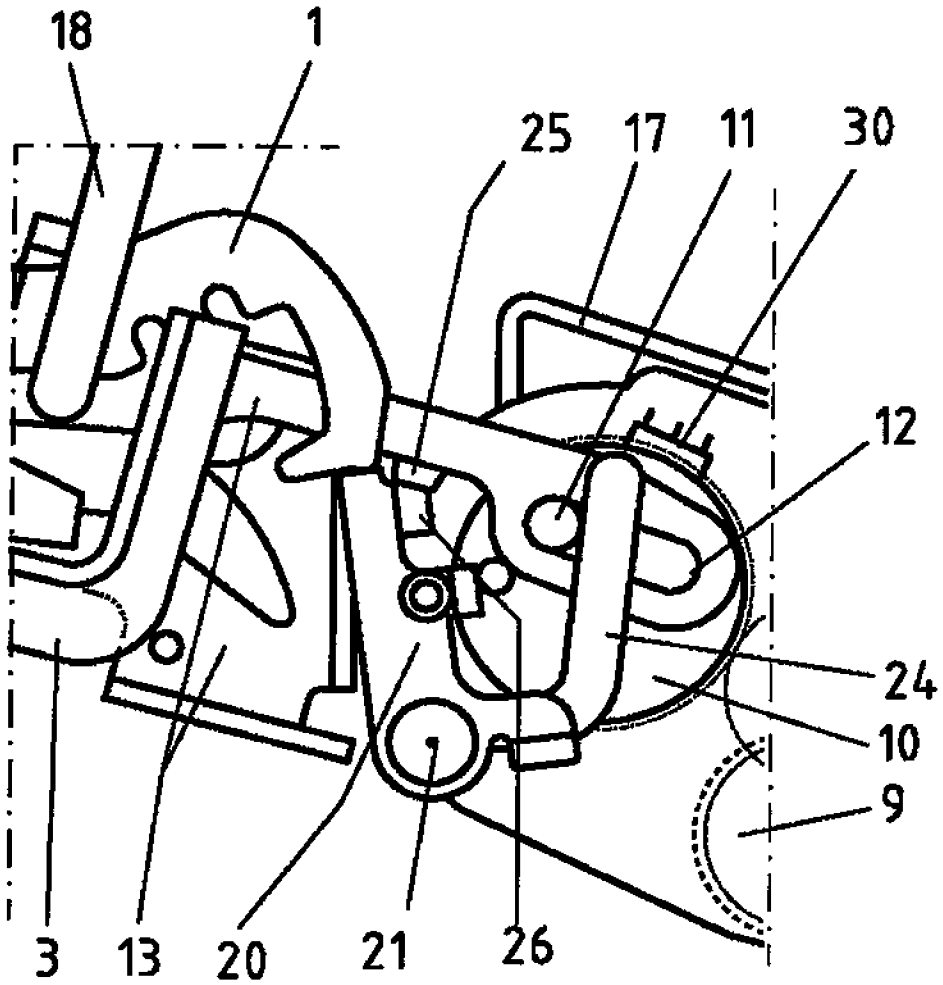
Figure 6:
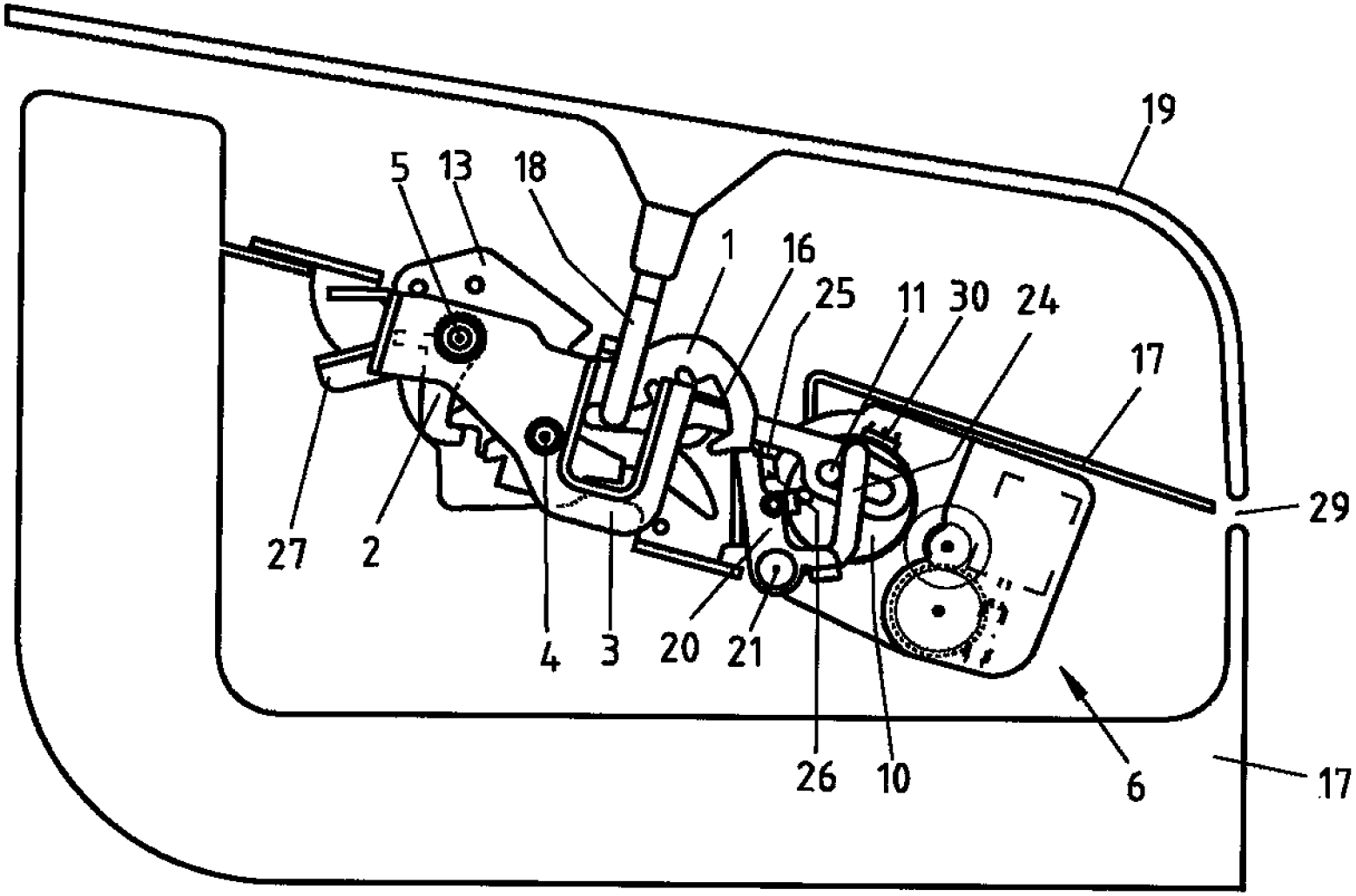
Figure 7:
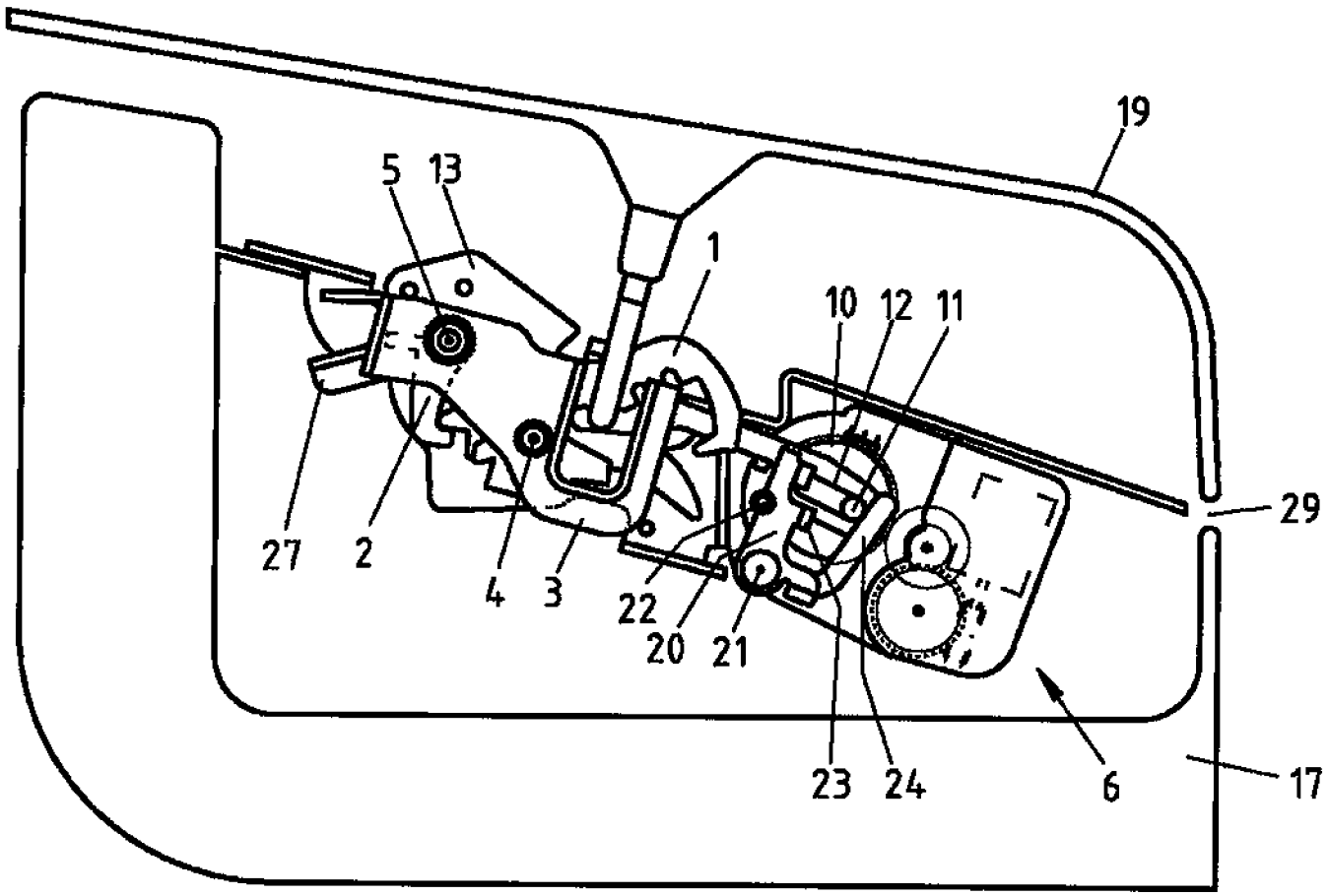
Figure 8:
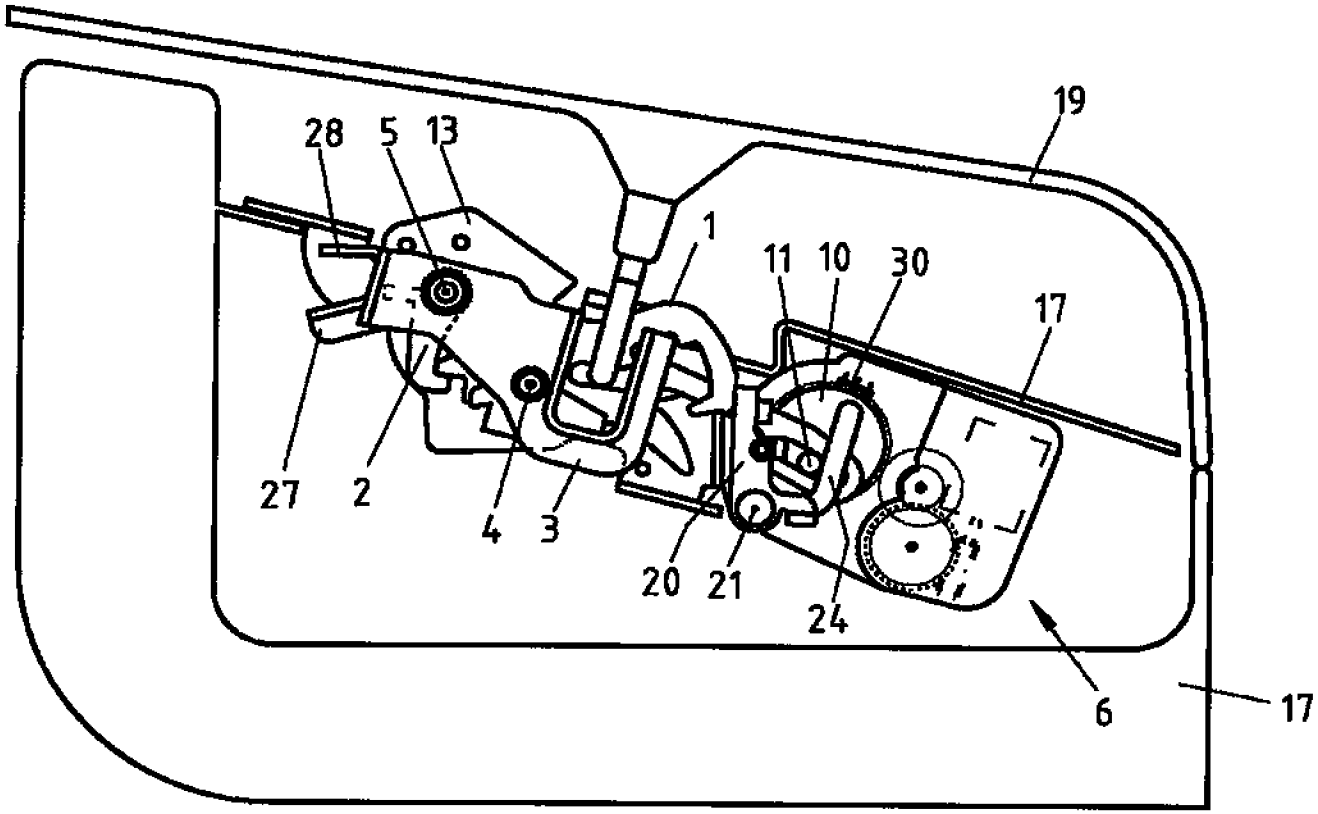
Figure 9:
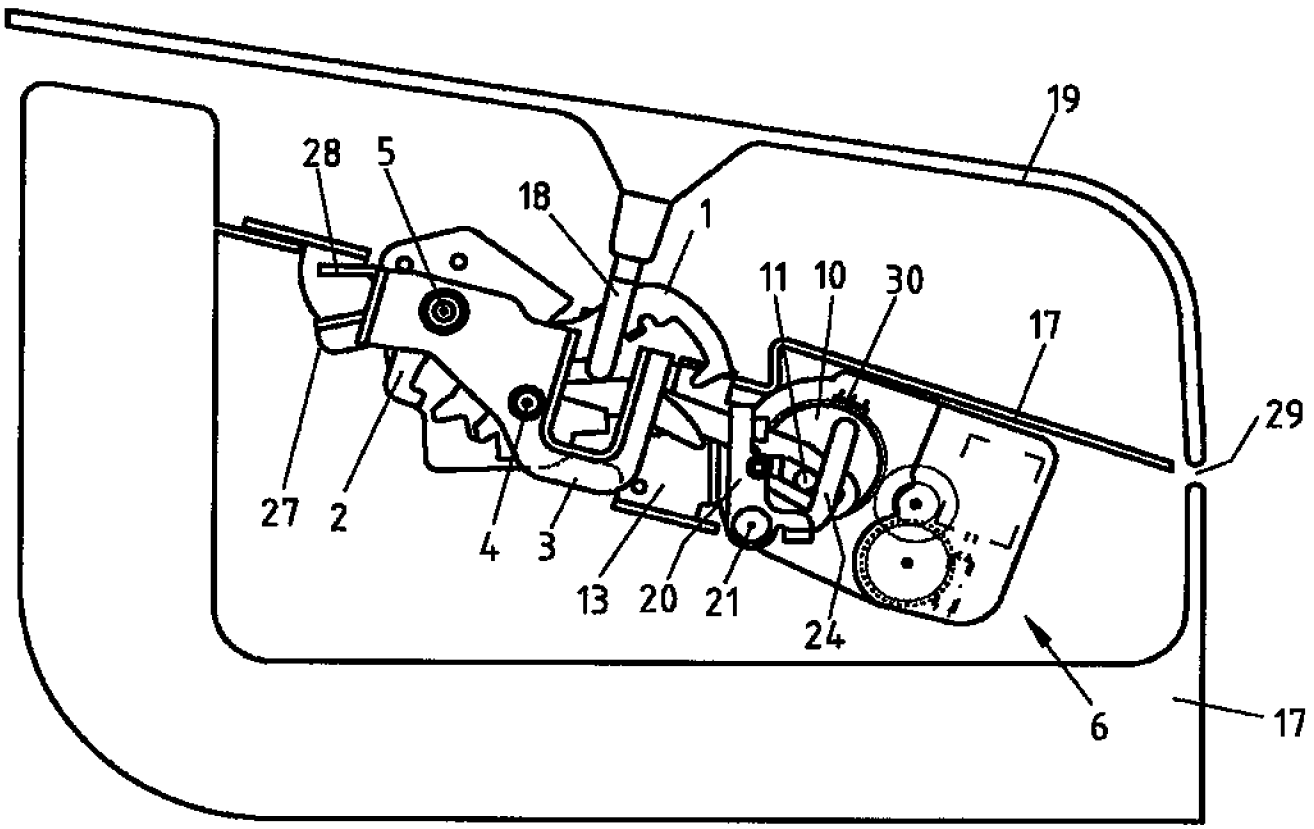
Figure 10:
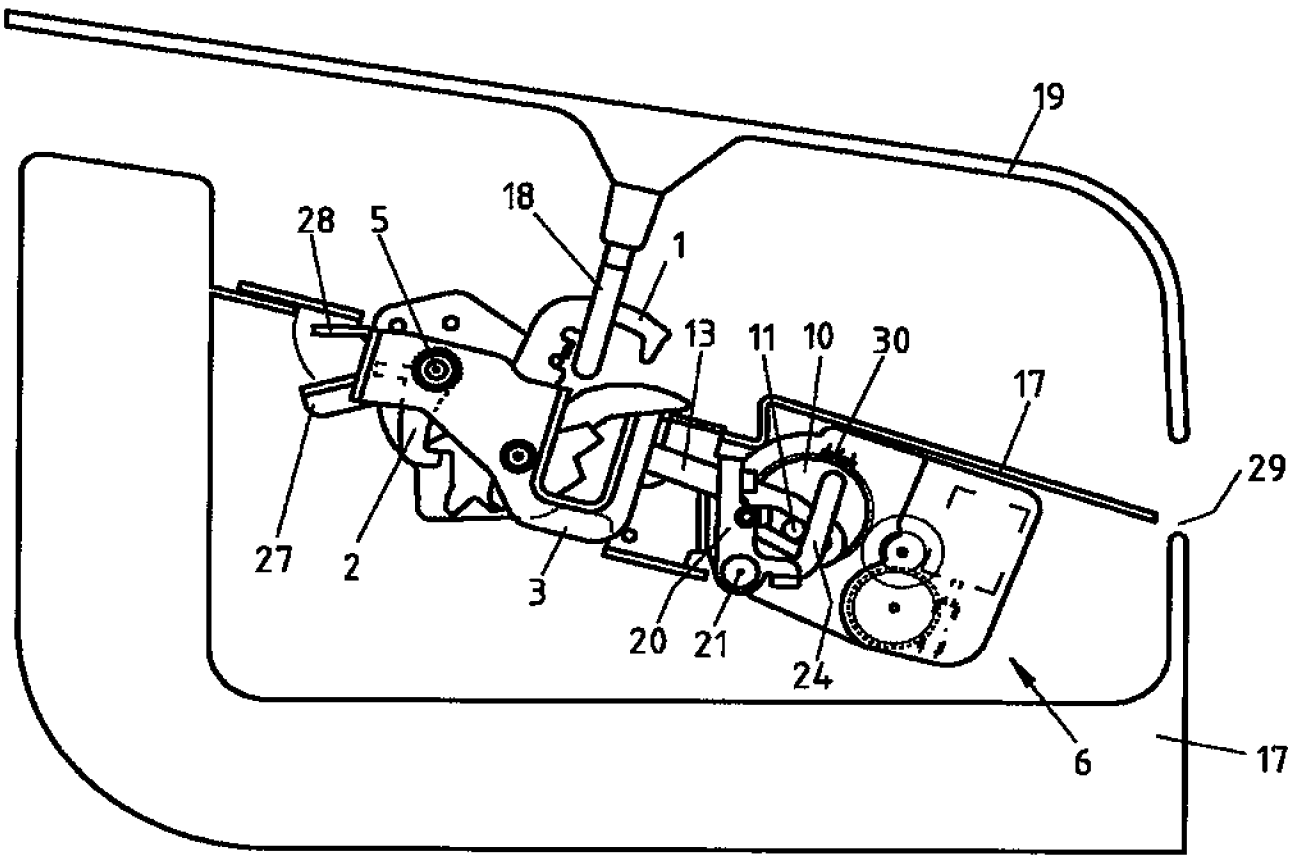
Figure 11:
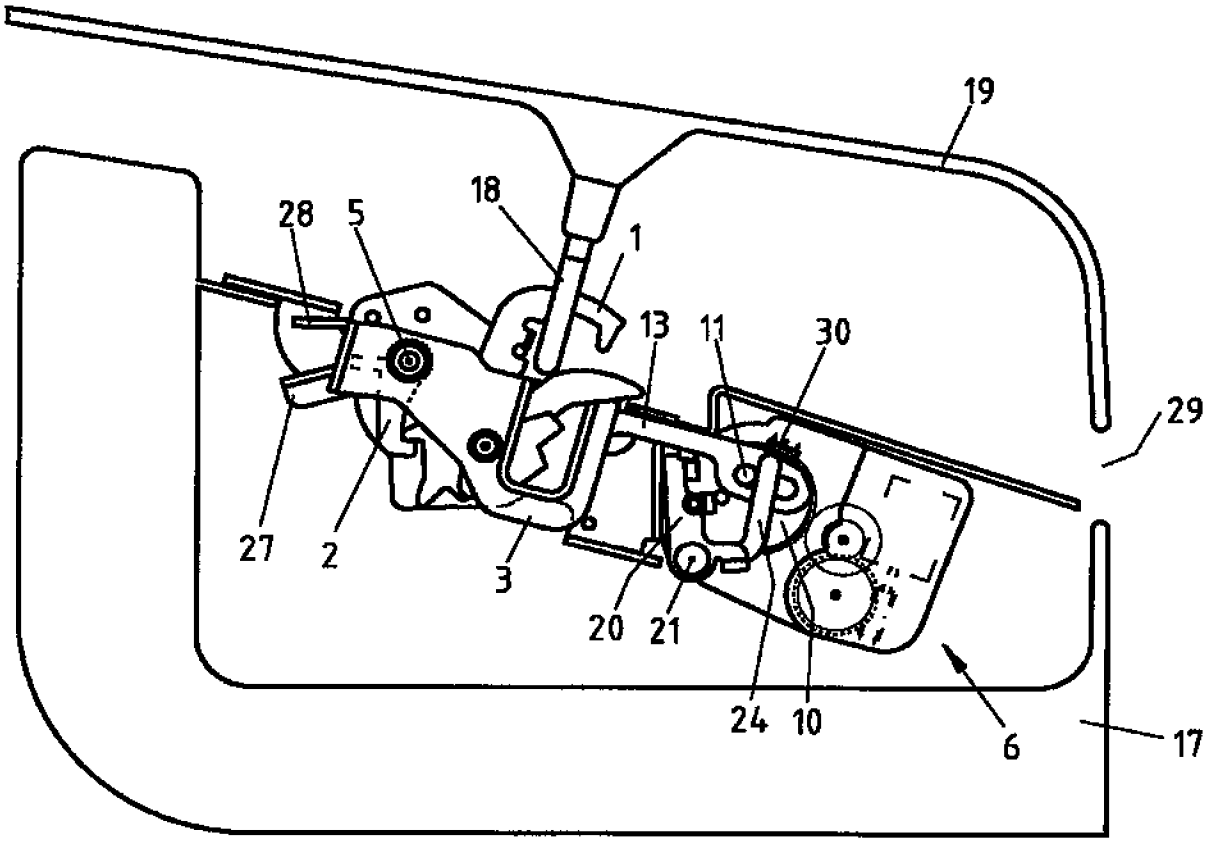
Figure 12:
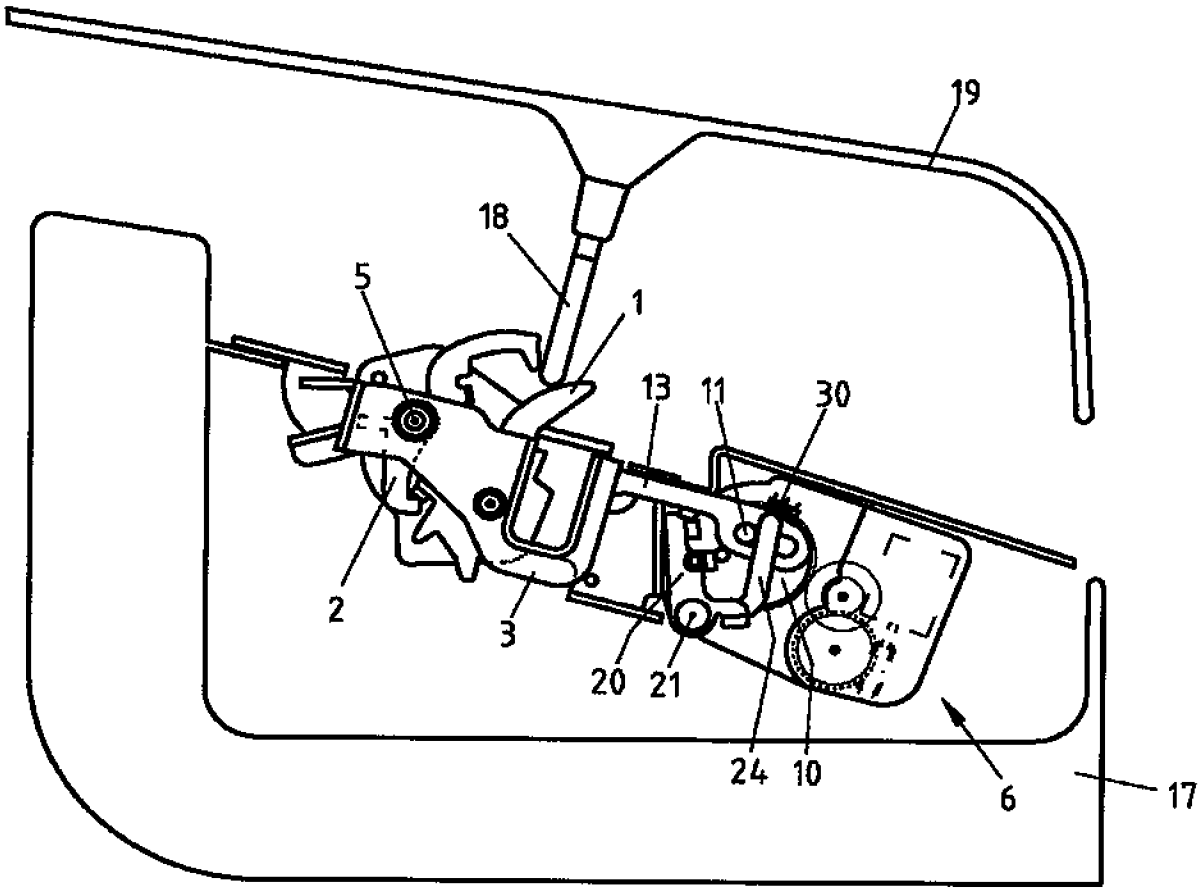
Figure 13:
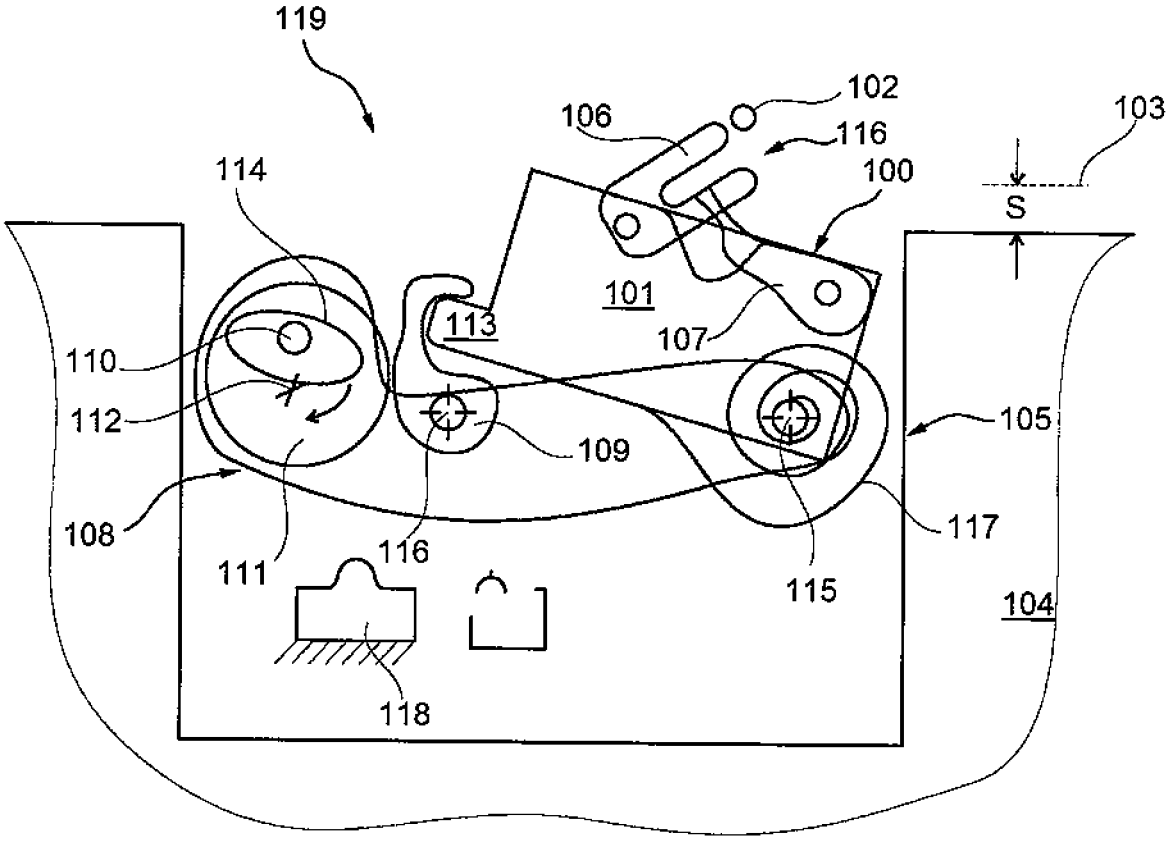
Figure 14:
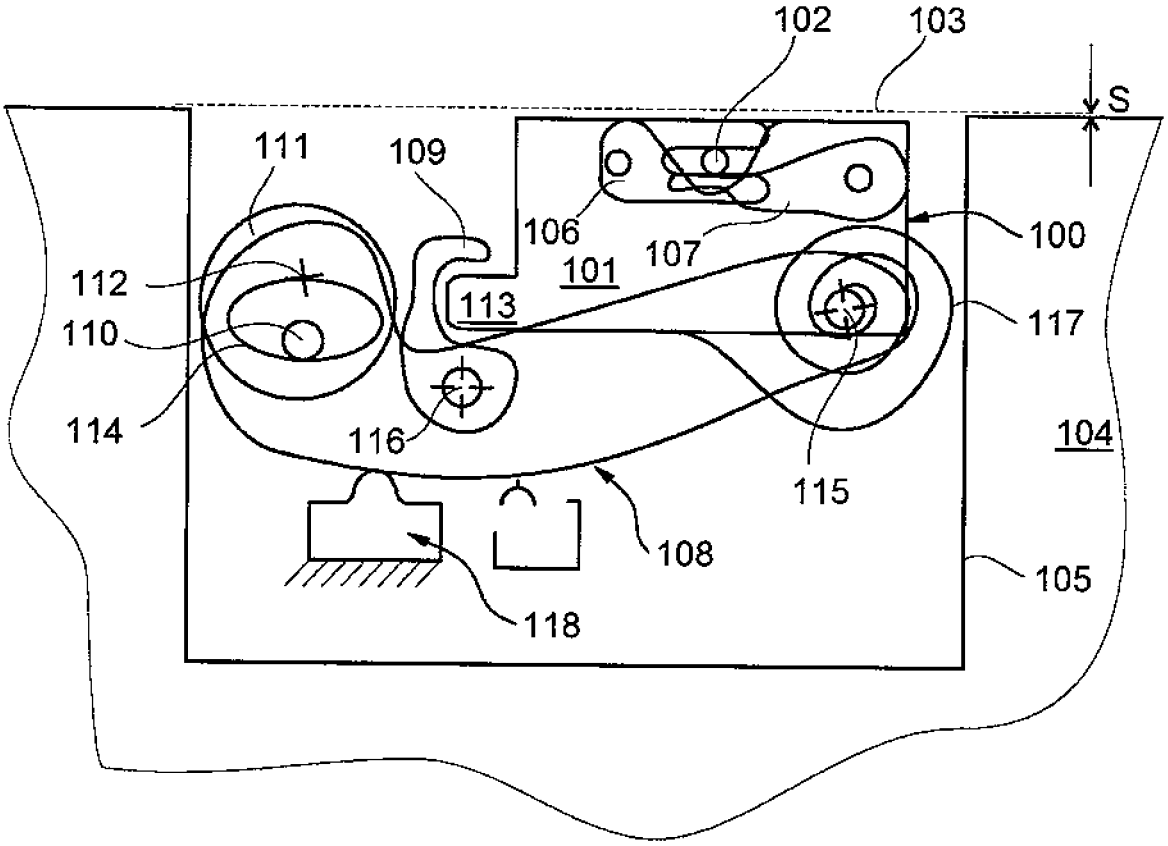

FIG. 1: Latch arrangement in the locked state (main ratchet position);

FIG. 2: Perspective view of latch;

FIG. 3: View from top of latch;

FIG. 4: Installed latch and hood;

FIG. 5: Enlarged view of a section when catch makes contact with stop of the latch;

FIG. 6: Initial closing of hood with remaining gap;

FIG. 7: Continuation of locking process;

FIG. 8: Complete locking of hood;

FIG. 9: Initial opening of hood;

FIG. 10: Continuation of opening of hood;

FIG. 11: Hood and blocking of catch in pre-ratchet position;

FIG. 12: Complete opening of hood;

FIG. 13: Locking device with open hood in example;

FIG. 14: Object of FIG. 13 with closed hood.

FIG. 1 illustrates the design of a locking device for a door or hatch of a motor vehicle. The locking device contains a latch with a locking mechanism comprising catch 1 and pawl 2. The catch 1 can be locked in a closed position with the pawl 2, as shown in FIG. 1. The pawl 2 is pivotally mounted on a latch plate 3 by means of an axis 5. The pawl 2 is pivotally mounted on the latch plate 3 by means of its axis 5. The arrangement can contain a frame box instead of a latch plate 3. In the present arrangement, a latch plate 3 is, however, preferred for reasons of space which in contrast to a frame box does not contain any side walls. For reasons of stability, the latch plate 3 or the frame box are preferably made of metal. The pawl 2 and/or catch 1 are preferably also wholly or partly made of metal.

Using a drive 6, the locking mechanism comprising catch 1 and pawl 2 can be moved in such a way that a door gap or hatch gap can be reduced. For this purpose, the drive 6 contains, in particular, an electric motor 7 and a worm 8 connected to the shaft of the motor. The motor 7 can effect a pivoting movement of the worm 8. A pivoting movement of the worm 8 produces a pivoting movement of a wheel 10 by means of a, preferably provided, multi-stage gear system 9. A bolt 11 extends perpendicularly from the wheel 10. The bolt 11 is fixed to the wheel 10. The bolt 11 is mounted at a distance from the rotation centre of the wheel 10 and is thus eccentrically arranged. The bolt 11 extends into a slot 12 of a pivotally mounted lever or rocking lever 13. The rocking lever 13 is pivotally mounted by means of an axis or shaft 5. Rotation of the wheel 10 thus causes the rocking lever 13 to be displaced.

The lever 10 and the latch plate 3 are connected to the shaft 5. Pivoting of the lever 13 thus results in synchronous pivoting of the latch plate 3.

When viewed from the shaft 5, the latch plate 3 and rocking lever 13 extend in the same direction and, preferably, in the direction of the drive 6 in order to keep the required installation space to a minimum. The rocking lever 13 extends past the latch plate 3 and, in particular, past the infeed section of the latch plate 3, i.e. past the area entered by the locking bolt when an associated door or hatch is closed. As a result, favorable lever ratios are provided so that the rocking lever 13 can be pivoted with little electric power in order to reduce a gap of a door or hatch.

In addition, the locking device contains a first plate 14 shown in FIGS. 2 and 3. For reasons of stability, the opposite side preferably contains a second plate 15. The two plates 14 and 15 are pivotally mounted on the axis or shaft 5. For reasons of stability, the one or two plates 14 and 15 are preferably made of metal. Using bent tabs 16 containing holes, the one or two plates 14 and 15 are secured with notches or bolts on, for instance, a door, hatch or a motor vehicle body. Where one or two plates 14 and 15 are mounted on the motor vehicle body 17, as shown in FIG. 4, the associated locking bolt 18 (see FIG. 4) is mounted on the door or hatch 19. FIG. 4 shows a fixing on a front bonnet of a motor vehicle. The drive 6 is mounted on the plate 15. One of the plates 14 or 15 preferably also serves as a fixing for the drive in order to keep the number of parts to a minimum.

The locking device contains a web-shaped stop 20, pivotally secured to the plate 14 by means of an axis or shaft 21. In particular, a bolt 22 extends perpendicularly from plate 14 and is able to restrict a pivoting movement of the stop 20 (see FIGS. 2 and 3). The web-shaped stop 20 contains a preferably bent tab 23 that can be moved against the bolt 22 by pivoting in order to prevent a continuation of a respective pivoting movement when reaching bolt 22, as shown in FIGS. 1, 2 and 3.

Viewed from the axis or shaft 21, a shackle 24 does for instance extend, serving to control movement of stop 20. Together with stop 20, the shackle 24 is more or less U-shaped in one embodiment. Generally the shackle 24 rests against the bolt 11. When the wheel 10 is pivoted, the shackle 24 is also moved because of the bolt 11. Displacement of the shackle 24 causes a respective synchronous movement of stop 20.

Stop 20 not only serves as a stop for the catch 1 but also as a stop for rocker arm 13 when the locking bolt 18 engages in the latch. In order to ensure that the stop 20 also serves as a stop for rocking lever 13 in a preferred embodiment, the stop 20 and the rocking lever 13 contain suitable bent tabs 25 and 26. Once the locking bolt 18 engages in the latch, the bent tab 25 of the rocking lever 13 comes into contact with the bent tab 26 of stop 20 as the enlarged section of FIG. 5 shows. FIG. 5 also shows one end of an arm of the catch 1 coming in contact with the end of the stop 20. This embodiment thus offers two options of transferring a load onto plate 14 during closing, thus protecting the drive 6.

The latch also contains a triggering lever 27 also pivotally mounted on the axis or shaft S. The triggering lever 27 is actuated by a Bowden cable—not shown. By actuating the Bowden cable, the pawl 2 is moved out of its engaged position, allowing a door or hatch to be opened. The triggering lever 27 can contain a hook 28 for engaging the Bowden cable.

FIG. 3 shows, for instance, that the axes/shafts can contain springs for moving the pivotable components by the force of the springs, as for instance the catch 1 from a closed towards an open position.

FIG. 6 shows the situation after the locking bolt 18 has engaged in the latch. One arm of the catch 1, the so-called load arm, rests on stop 20. The tab 25 of the rocking lever 13 rests on the tab 26 of the stop 20. The catch 1 has been locked by the pawl 2 and is in the main ratchet position. A gap 29 remains between the hood 19 and the body 17 of the motor vehicle. The wheel 10 of the drive 6 is in its initial position. In the initial position the bolt 11 is located in one embodiment above the centre of rotation of the wheel 10.

In one embodiment it is, however, also possible for the catch 1 to be initially only locked in the pre-ratchet position shown in FIG. 10 as a result of the locking bolt 18 engaging. Only once stop 20 is moved out of its stop position can the catch be pivoted into the main-ratchet position by means of an electric drive and, in particular, an electric motor 7 and a mechanism—not shown. In this embodiment, the gap 29 can be reduced to 2-4 mm as a result of reaching the main-ratchet position.

In order to reduce the gap 29 further, starting from the main-ratchet position of the locking mechanism, the wheel 10 is turned clockwise with the aid of the drive 6. As a result, the bolt 11 moves within the slot 12 as a result of a quarter turn first from the one left side of the slot to the other right side of the slot, as apparent when comparing FIGS. 6 and 7. By turning in clockwise direction, the stop 20 is pivoted with the aid of the shackle 24 in clockwise direction out of its stop position. Once the stop 20 has been moved out of its stop position, the rocking lever 13 and thus also the latch plate 3 can be pivoted clockwise around its axis or shaft 5 in order to reduce the gap 29 further in order to finally provide a gapless contact between bonnet 19 and motor vehicle body 17 at the front, as shown in FIG. 8. If wheel 10 is turned further in clockwise direction and if the wheel 10 thus carries out an approx. 180° rotation, the gap finally disappears, as shown in FIG. 8.

The position of the wheel 10 is, for instance, determined with the aid of a micro switch 30. Once the wheel 10 has reached the position shown in FIG. 8 this is sensed by the micro switch 30, stopping the drive. Alternatively or in addition, a current detector (current for electric motor) can determine the reached position, allowing suitable switching. One or several micro switches can be provided in order to determine, for instance, the position of catch 1 and/or pawl 2 and to control blocking and/or opening of the locking mechanism depending on said position.

FIGS. 9 to 12 show the opening of the hood 19. First, the pawl 2 is moved out of its engaged position as shown in FIG. 9. This is achieved by actuating the triggering lever 27, which for this purpose is pivoted clockwise around its axis or shaft 5. The catch 1 can then be pivoted counterclockwise resulting in the hood 19 being partially opened. A gap 29 is created. The catch 1 now engages in a pre-ratchet position as shown in FIG. 10. Engaging in the pre-ratchet position is again achieved with the aid of the pawl 2. The position reached in FIG. 10 can, for instance, be detected by a micro switch or a sensor. Consequently, the drive 6 can be started in such a way that the wheel 10 now turns counterclockwise by around 180°. As a result, the position shown in FIG. 11 is reached. The pawl 2 is then pivoted out of the position shown in FIG. 11. This can be achieved by means of an electric drive controlled by sensors to electrically open the latch. The catch 1 can then be pivoted further in the direction of the open position to finally release hood 19, as shown in FIG. 12.

The rocking lever 13 can contain a bent tab 31 as shown in FIG. 2. The tab 31 can rest on a top edge of the plate 15 when the wheel 10 has been turned by approx. 180° from its starting position. This can also ensure a suitable limitation of travel for pivoting the rocking lever 13.

The rocking lever 13 can be stepped, as shown in FIG. 2 in order to reach the wheel 10 and keep the required space to a minimum.

FIGS. 12 and 13 show a locking device whose basic design includes a latch housing 100 on the side of the motor vehicle body and a locking bolt 102 on the side of the hood. This means that the locking bolt 102 is connected to a hood or bonnet 103 only indicted by a dashed line. This means that the invention discloses a hood latch although the invention is naturally not limited to this.

The attachment or arrangement of the latch housing 100 on the motor vehicle body is shown in FIGS. 13 and 14 in such a way that only a top front beam 104 is indicated in the figures as part of the motor vehicle body 104. The front beam 104 contains a recess 105 inside which the latch housing 100 is accommodated.

The latch housing 100 generally contains a frame box 101 as shown and a latch cover connected or connectable to a frame box 101—not shown. Whilst the frame box 101 is made of metal and is solid in order to accommodate a locking mechanism 106, 107 mounted therein, the latch cover—not shown—is typically made of plastic. The locking mechanism 106, 107 comprise a usual catch 106 and pawl 107 that are both pivotally mounted inside the frame box 101 as apparent from the hollow circles indicating the axes of rotation when comparing FIGS. 13 and 14 respectively.

The further basic design includes a closing and opening device 108, 109. In this example embodiment, the closing and opening device 108, 109 is designed as a locking device 108, 109 comprising a rocker arm 108 and a pawl 109 although the invention is not restricted to being a locking device. The Figures also show a motorized drive 110, 111. The motorized drive 110, 111 comprises a driving wheel 111 and an actuating wheel located on the driving wheel 111. The actuating journal 110 does indeed generally extend perpendicular from the driving wheel 111.

The driving wheel 111 in turn is pivoted around an axis 112 in clockwise and counterclockwise direction with the aid of an electric motor—not explicitly shown. For this purpose, the driven shaft of the electric motor contains a worm meshing with an external gearing on the outside of the driving wheel 111. During the transition from the functional position of FIG. 13 to the functional position of FIG. 14, the driving wheel 111 carries out a clockwise rotation around its axis 112, taking into consideration a circular arc of around 180°, defined by the actuating journal 10.

Of special significance for this embodiment of the invention is the circumstance that the closing and/or opening device 108, 109 or the locking device 108, 109 of the invention engages with the outside of the latch housing 100 in order to adjust the latch housing in relation to the fixed base element 104 as part of a closing/opening operation. As part of this operation, the pawl 109 extends over or behind a projection 113 on the latch housing 100 or a projection 113, which in this case is formed in or on the frame box 101. As a whole, the motorized drive 110, 111 acts eccentrically on the closing and/or opening device 108, 109, as apparent when comparing FIGS. 13 and 14. For this purpose, the actuating journal 110 engages in a slot 114 in the rocker arm 108. The actuating journal 110 actually extends through the respective slot 114 in the rocker arm 108.

The rocker arm 108 is pivotally connected to the base element 104. The same applies to the latch housing 100. In FIGS. 13 and 14 of the embodiment, a design is shown in which the rocker arm 108 and the latch housing 100 are pivotable around the same axis and are connected to the respective basic housing 104. For this purpose, a bolt 115 is provided which is anchored in the base element 104 or the front beam 104, provided at this point. The rocker arm 108 and the latch housing 100 or the frame box 101 are pivotally mounted on this fixed bolt 115. The design may be such that, in the shown view, the rocker arm 108 is arranged below the latch housing 100 and thus also below the frame box 101. This also applies to the pawl 109 which in turn is pivotally mounted on the rocker arm 108. Another bolt 116 is provided for this purpose. In this arrangement, the projection 113 can extend to such a point that the pawl 109 can reach over or behind said projection.

The device functions as follows. FIG. 13 shows the locking device and thus the associated hood 103 in its "open" position. In order to close the hood 103 it is manually lowered in relation to the motor vehicle body 104 or the front beam 104 to such an extent that the locking bolt 102 mounted on the hood engages as usual in the catch 106 or an infeed section 116 thereof. As a result, the catch 106 is pivoted clockwise around its axis until it finally reaches the main ratchet position shown in FIG. 14. In the main ratchet position the pawl 107 engages in the catch 106, preventing the catch 106 from being pivoted open by the force of a spring, thus releasing the retained locking bolt 102.

In the main ratchet position of the locking mechanism 106, 107, the hood 103 still contains a significant gap S in relation to the motor vehicle body 104 or the front beam 104, as indicated in FIG. 13. This is due to the fact that the closing and/or opening device 108, 109 or the provided pulling-closed device 108, 109 is in its ready position. At the same time, the latch housing 100 is pivoted away from the motor vehicle body 104. The motorized drive 110, 111 also ensures in this position that the hood 103 or the locking bolt 102 cannot flex. This means that the hood 103 or the locking bolt 102 reliably reach the main ratchet position of the locking mechanism 106, 107 as shown in FIG. 14.

The main ratchet position is now in turn detected by a sensor, for instance, a switch. As a result, the motorized drive 110, 111 is acted upon, starting from the ready position as shown in FIG. 13.

As soon as the motorized drive 110, 111 has received the starting signal from the respective sensor or switch on the locking mechanism 106, 107, indicating that the locking mechanism 106, 107 is in the main ratchet position, the electric motor is energized. This results in a clockwise movement of the driving wheel 111 around its axis or axis of rotation 112. The actuating journal 110 extending through the slot 114 in the rocker arm 108, acts accordingly on the rocker arm 108 or locking device 108, 109 in an overall eccentric manner. During this process, the actuating journal 110 carries out an approximately 180° circular movement as apparent from the transition between FIG. 13 and FIG. 14.

At the end of this closing operation as shown in FIG. 14, the actuating journal 110 has moved from a top edge of the slot 114 up to the opposite bottom edge, whilst at the same time pivoting the rocker arm 108 clockwise around its axis or axis of rotation 115. As during the entire process the pawl 109 has retained the latch housing 100 at projection 113 and as the pawl 109 is also pivotally mounted on the rocker arm 108 and is moved along with it, the latch housing 100 also carries out a counterclockwise movement around the common axis 115 together with rocker arm 108 during the transition from FIG. 13 to FIG. 14. The closing operation corresponds to this.

The locking movement of the latch housing 100 or of the rocker arm 108 is carried out against the force of a spring 117. The spring 117 is a spiral spring, whose one end is attached to bolt 115 connected to the motor vehicle body 104, whilst the other free end of the spiral spring 117 pretensions the latch housing 100 and in clockwise direction in relation to the axis or axis of rotation 115.

An end stop or stop buffer 118 on the motor vehicle body 104 provides an end position damping during the described closing process. This is due to the fact that upon reaching the closed position or pulled-closed position shown in FIG. 14, the rocker arm 108 pivoted around axis 115 with the aid of the motorized drive 110, 111 moves against the respective stop or stop buffer 118. The hood 103 is then completely closed in relation to the motor vehicle body 104 corresponding to a minimum gap S as shown in FIG. 14.

FIG. 13 also shows a pyrotechnical element 119 indicated by an arrow. This element ensures that during an accident, the hood 103 can be opened. For this purpose, the pyrotechnical element 119 acts on the pawl in order to pivot it away from the projection 113 on latch housing 100.

The embodiment shown in FIGS. 12 and 13 also preferably contains a closing aid able to move the locking mechanism with its electric drive from a pre-ratchet to a main ratchet position in order to reduce the gap S in a first step. Alternatively or in addition, the latch is designed in such a way that is can be opened with the aid of an electric motor.

LIST OF REFERENCE NUMBERS

1: Catch
2: Pawl
3: Latch plate
4: Axis for catch
5: Axis for pawl, amongst other things
6: Drive
7: Electric motor
8: Worm
9: Gear system
10: Wheel
11: Bolt of wheel
12: Slot of a rocking lever
13: Rocking lever
14: Plate for a stop
15: Plate
16: Tab
17: Motor vehicle body
18. Locking bolt
19: Hood
20: Stop

21: Axis or shaft of stop
22: Bolt of a plate
23: Tab
24: Shackle of stop
25: Bent tab of rocking lever
26: Bent tab of stop
27: Triggering lever
28. Hook of triggering lever
29: Gap between hood and motor vehicle body
30: Micro switch
31: Bent tab of rocking lever
100: Latch housing
101: Frame box
102: Locking bolt
103: Bonnet
104: Front beam
105: Recess
106 Catch
107: Pawl
108: Rocker arm
109: Pawl
110: Actuating journal
111 Driving wheel
112: Axis
113: Projection
114: Slot
115: Bolt
116: Bolt
117: Spring
118: Stop buffer
119: Pyrotechnical Element
S: Gap

The invention claimed is:

1. A locking device for a door or hatch of a motor vehicle, the locking device comprising:

a locking mechanism having a catch and a first pawl for blocking the catch; and a motorized drive that is a closing aid, the drive including a driving wheel from which an eccentrically arranged bolt projects, a rocking lever defining a slot into which the bolt extends for moving the locking mechanism, and a second pawl mounted on the rocker arm; and a latch housing to which the locking mechanism is mounted, wherein the second pawl is engageable with an outside of the latch housing to retain the latch housing during movement of the rocking lever for movement of the latch housing with the rocking lever, whereby the locking mechanism is displaced in relation to a fixed base element.

2. The locking device according to claim 1, wherein the locking mechanism can only be moved from a pre-ratchet to a main ratchet position by the closing aid.

3. The locking device according to claim 1, wherein the rocker is pivotally connected to the base element.

4. The locking device according to claim 1, wherein the rocker and the latch housing are connected to the base housing in such a way that they pivot around the same axis.

5. The locking device according to claim 1, wherein the pawl is pivotally mounted on the rocker.

6. The locking device according to claim 1, wherein the eccentrically arranged bolt carries out circular movements within the slot that are initiated by the motorized drive, in order to pivot the rocker and with it the latch housing around the axis in relation to the base element.

7. The locking device according to claim 1, wherein the latch housing is connected to the base element and pivotally around an axis.

* * * * *